US007540492B2

(12) United States Patent
Miyazaki

(10) Patent No.: US 7,540,492 B2
(45) Date of Patent: Jun. 2, 2009

(54) IMAGE FORMING APPARATUS

(75) Inventor: Yoshiyuki Miyazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 11/623,823

(22) Filed: Jan. 17, 2007

(65) Prior Publication Data

US 2007/0170640 A1 Jul. 26, 2007

(30) Foreign Application Priority Data

Jan. 26, 2006 (JP) ..... 2006-018268

(51) Int. Cl.
*B65H 1/18* (2006.01)

(52) U.S. Cl. ..... 271/153; 271/152

(58) Field of Classification Search ..... 271/152, 271/153, 110, 127
See application file for complete search history.

(56) References Cited

U.S. PATENT DOCUMENTS 6,105,954 A * 8/2000 Magee et al. ..... 271/10.03
6,918,583 B2 * 7/2005 Asada et al. ..... 271/110
2004/0041329 A1 * 3/2004 Hiraoka ..... 271/110
2005/0184448 A1 * 8/2005 Aoyagi et al. ..... 271/110

FOREIGN PATENT DOCUMENTS

| | | | |
|---|---|---|---|
| GB | 2271763 A | * | 4/1994 |
| JP | 04327442 A | * | 11/1992 |
| JP | 06144642 A | * | 5/1994 |
| JP | 2002-012336 | | 1/2002 |
| JP | 2002-362811 | | 12/2002 |

* cited by examiner

*Primary Examiner*—Kaitlin S Joerger
(74) *Attorney, Agent, or Firm*—Fitzpatrick, Cella, Harper & Scinto

(57) ABSTRACT

A detecting device for detecting the presence or absence of a sheet contained in a sheet containing portion includes a rotatable arm portion brought into contact with the sheet contained in the sheet containing portion, a stopper portion rotatable in association with the arm portion for determining the position of the arm portion when there is no sheet in the sheet containing portion and whose rotation is regulated when there is no sheet in the sheet containing portion. And when the sheet in a conveying path is to be pulled out, the arm portion is retreated from a position determined by the stopper portion due to the pressure of the sheet being pulled out.

6 Claims, 6 Drawing Sheets

IMAGE FORMING APPARATUS

BACKGROUND OF THE INVENTION

1. Field of the Invention

The present invention relates to an image forming apparatus and particularly to a construction of a detecting device for detecting the presence or absence of a sheet.

2. Description of the Related Art

An image forming apparatus, which can form an image on both sides of a sheet, can be cited as a conventional example of an image forming apparatus such as a printer, facsimile, and copier. FIG. 7 is a view illustrating a construction of a laser beam printer, which is an example of such a conventional image forming apparatus.

In FIG. 7, a laser beam printer 101 comprises an image forming portion 102 for forming an image on a sheet P and a feeding unit 105 for feeding the sheet P to the image forming portion 102. Moreover, this laser beam printer 101 is provided with a sheet re-feeding and conveying portion 103 for feeding sheets to the image forming portion 102 again for forming an image on the back side of the sheet after an image is formed on one side of the sheet, and a discharge path 150 for discharging the sheet on which an image is formed on one side or both sides.

Here, the image forming portion 102 comprises a process cartridge 107 including a photosensitive drum 108, a transfer roller 109, and the feeding unit 105 is provided with a sheet feed cassette 104 on which the sheet P is stacked, and a feeding roller 106. The sheet re-feeding and conveying portion 103 comprises a switchback portion provided with a flapper 139, an after-fixation roller 117 also used as a switchback roller, and a switchback rotatable member 119. Moreover, the sheet re-feeding and conveying portion 103 comprises a reversing path 137 including a pair of conveying rollers (not shown) and a re-conveying path R on which a lateral registration correction portion 123 including an oblique-feed rotatable member 126, and a sheet re-feeding roller 122 are arranged.

A fixing unit 110 and a laser scanning unit 112 are also provided. A sheet discharge portion 113 includes a pair of switchback rollers 114, 115 and a sheet discharge/stacking table 116. A rotatable member 118 is brought into pressure contact with the after-fixation roller 117.

A sensor flag 150 constitutes a presence or absence sensor (not shown) for detecting the presence or absence of the sheet P inside the sheet feed cassette 104. This sensor flag 150 is brought into contact with the sheet P by the gravitational force of the sensor flag 150 or an urging unit (not shown). A controller board 111 controls the operation of the laser beam printer 101. The controller board 111 detects the presence or absence of the sheet P inside the sheet feed cassette 104 based on a signal from the presence or absence sensor.

In the above laser beam printer 101, when the controller board 111 issues a print signal based on image information sent from a personal computer (not shown), the sheet P stacked on the sheet feed cassette 104 is fed by the feeding roller 106 one by one. After that, the sheet P is conveyed to a nip between the photosensitive drum 108 and the transfer roller 109 and the fixing unit 110 in this order, and an image is formed on the sheet.

Here, if the controller board 111 has received a signal for forming an image on one side (one-side printing), then, the sheet P is held between the after-fixation roller 117 and the rotatable member 118 and fed directly through the discharge path 150 to the sheet discharge portion 113 by forward rotation of the after-fixation roller 117. Thereafter, the sheet P is discharged by the pair of switchback rollers 114, 115 onto the sheet discharge/stacking table 116.

Also, when the controller board 111 has received a signal for forming images on both sides (double-side printing), the pair of switchback rollers 114, 115 is reversely rotated, and the flapper 139 is switched. By this, the sheet P having been conveyed to the discharge path 150 is guided by the switched flapper 139 to the nip between the after-fixation roller 117 and the switchback rotatable member 119 and subsequently fed to the sheet re-feeding and conveying portion 103 with its leading edge and trailing edge reversed.

Then, the sheet P having been thus fed to the sheet re-feeding and conveying portion 103 in the state where the leading edge and trailing edge are reversed enters the re-conveying path R through the reversing path 137 and then, reaches the lateral registration correction portion 123. Here, at the lateral registration correction portion 123, an oblique-feed force is exerted on the sheet P by an oblique-feed roller 125 and the oblique-feed rotatable member 126 in contact with this oblique-feed roller 125, by which the sheet P is conveyed and brought closer to a reference plate 124 for correcting the skew feed of the sheet P.

When the sheet P reaches the reference plate 124 after that, the side end of the sheet P is conveyed along the reference plate 124, and thereby the sheet P is corrected to the proper state without skew feed or displacement. Then, after this lateral registration correction, the sheet P is fed to the image forming portion 102 again by this sheet re-feeding roller 122 and a rotatable member 130 in contact with this sheet re-feeding roller 122, and an image is formed on the second side (back face). After that, the sheet P is conveyed to the sheet discharge portion 113 and stacked onto the sheet discharge/stacking table 116.

In this type of laser beam printer, a jam might occur in the re-conveying path R, for example. And as disclosed in Japanese Patent Application Laid-open No. 2002-362811 and Japanese Patent Application Laid-Open No. 2002-012336, some of laser beam printers are designed such that in the case of a jam, in order to remove the jammed sheet, a lower conveying guide 127 constituting the bottom surface of the re-conveying path R is rotated clockwise, for example, so as to open the re-conveying path R.

This type of laser beam printer is designed such that, as shown in FIG. 7, for example, a jam handling lever 146 is provided at a laser beam printer body 101A, and when a jam occurs in the re-conveying path R, the jam handling lever 146 is pulled outward. Here, if the jam handling lever 146 is pulled in this way, a cam 141 provided at the jam handling lever 146 is rotated clockwise, and locking by the cam 141 on a rotating end of the lower conveying guide 127 is released.

As a result, as shown in FIG. 8, the lower conveying guide 127 is rotated downward around a fulcrum 127*a* as its center of rotation, and by this downward rotation of the lower conveying guide 127, the re-conveying path R is opened. Then, the jamming is cleared by pulling out the jammed sheet P in a Z direction, that is, to the front side of the laser beam printer.

This type of conventional laser beam printer (image forming apparatus) is designed such that, if the re-conveying path R is opened by rotating the lower conveying guide 127 downward, the sheet P is pulled to the front side of the laser beam printer in order to remove the sheet P as mentioned above.

However, when the sheet P is thus pulled out, the sheet P might be caught by the sensor flag 150, and if the sheet P is caught in this way, the sheet P is torn and might remain in the laser beam printer.

SUMMARY OF THE INVENTION

Therefore, the present invention was made in view of the current circumstances and has an object to provide an image forming apparatus from which a jammed sheet can be pulled out without being torn.

The present invention is an image forming apparatus comprising an image forming portion, a conveying path configured to convey a sheet to the image forming portion, a sheet containing portion configured to contain the sheet, and a detecting device configured to detect the state of the sheet contained in the sheet containing portion, in which the detecting device includes an arm portion which is rotatable and brought into contact with the sheet contained in the sheet containing portion a sensor configured to output a signal according to the position of the arm portion and a stopper portion rotatable in association with the arm portion and determining the position of the arm portion while not in contact with the sheet contained in the sheet containing portion wherein the arm portion can be retreated from the position determined by the stopper portion to an outside position of a rotating range for an operation of detecting the sheet of the arm portion.

Further features of the present invention will become apparent from the following description of exemplary embodiments with reference to the attached drawings.

DESCRIPTION OF THE EMBODIMENTS

An embodiment for carrying out the present invention will be described below in detail with reference to the accompanying drawings.

Figure 1:
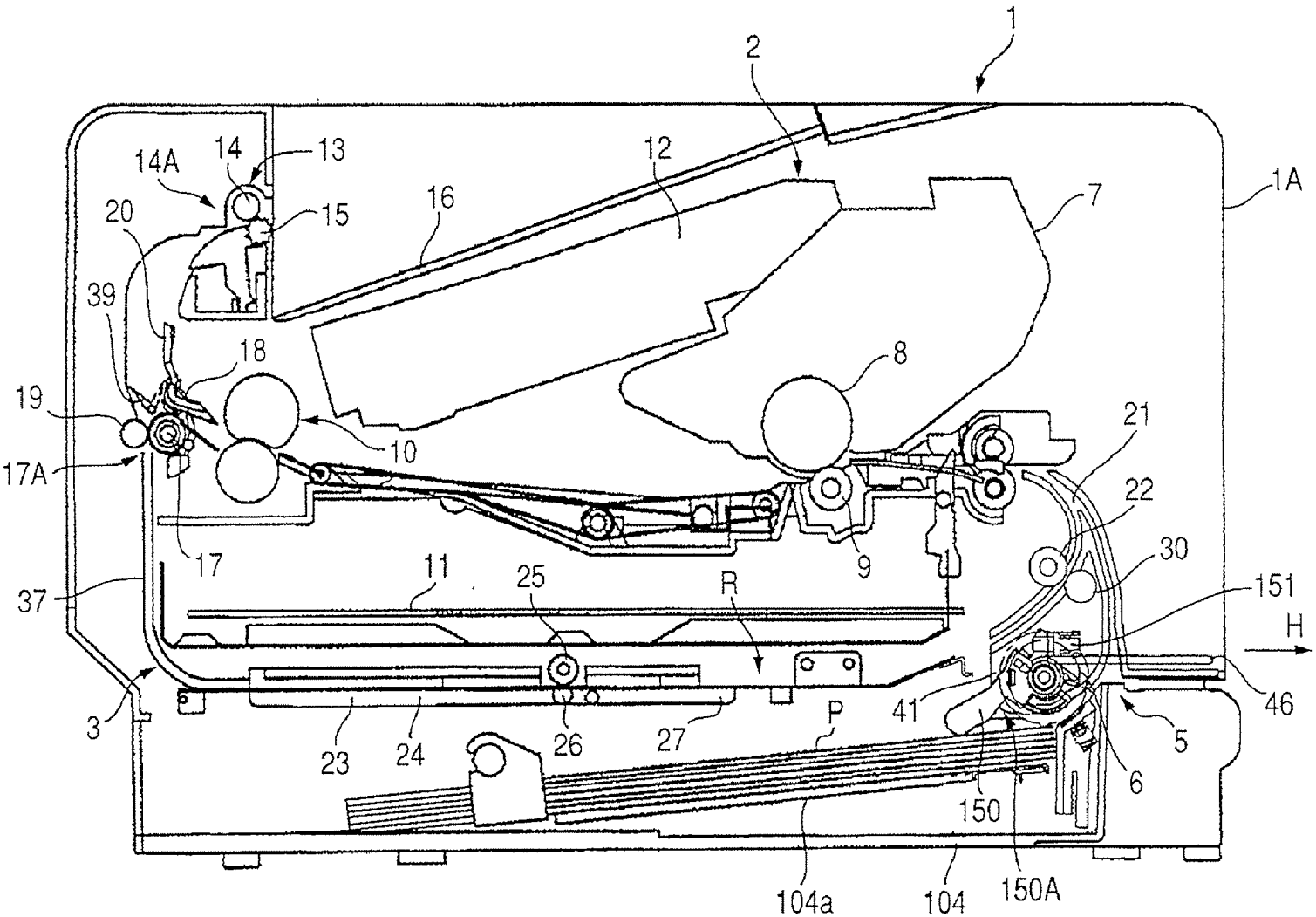
FIG. 1 is a view illustrating a construction of a laser beam printer, which is an example of an image forming apparatus according to a first embodiment of the present invention.

FIG. 1 is a view illustrating a construction of a laser beam printer, which is an example of an image forming apparatus according to a first embodiment of the present invention.

In FIG. 1, a laser beam printer 1 can form an image on both sides of a sheet and is provided with an image forming portion 2 for forming images. Also, this laser beam printer 1 is provided with a sheet re-feeding and conveying portion 3 for feeding a sheet P to the image forming portion 2 again for forming an image on the back side after an image has been formed on one side, a feeding unit 5 for separating and feeding the sheet P to the image forming portion 2 one by one.

Here, the image forming portion 2 is provided with a process cartridge 7, a transfer roller 9, and the feeding unit 5 is provided with a sheet feed cassette 104, which is a sheet containing portion for containing the sheet P, and a feeding roller 6. The process cartridge 7 is integrally provided with a photosensitive drum 8 and a process unit (a charging unit, a developing unit, or a cleaning unit) acting on the photosensitive drum 8 and is made detachable with respect to a laser beam printer body (hereinafter referred to as an apparatus body) 1A.

Also, the sheet re-feeding and conveying portion 3 is constituted mainly by a re-conveying path R from a pair of discharge rollers 14, 15 to a joining point 21 with a conveying path from the sheet feed cassette 104. This sheet re-feeding and conveying portion 3 is provided with a flapper 39, a switchback portion 14A including a pair of discharge rollers 14, 15, and a re-conveying path R on which a reversing path 37, an after-fixation roller 17, a lateral registration correction portion 23, a sheet re-feeding roller 22 are arranged.

This after-fixation roller 17 also serves as a switchback roller and constitutes a switchback portion 17A along with a second rotatable member 19. Also, with this after-fixation roller 17, a first rotatable member 18 for holding the sheet P with the after-fixation roller 17 so as to convey the sheet to the pair of discharge rollers 14, 15 is brought into pressure contact. Also, the sheet re-feeding roller 22 is provided on the downstream side of the lateral registration correction portion 23, and a sheet re-feeding rotatable member 30 is brought into contact with this sheet re-feeding roller 22, which is contactable to and separable from the sheet re-feeding rotatable member 30.

The lateral registration correction portion 23 is provided with an oblique-feed roller 25, an oblique-feed rotatable member 26 brought into contact with this roller and oriented diagonally, and a reference guide 24 for regulating a registration position in the width direction of the sheet P. After an image is formed on one side, by bringing the sheet P having been conveyed to form an image on the back side toward the reference guide 24 by the oblique-feed roller 25, a function is exerted to correct the position of the sheet P in the width direction in preparation for image formation on the second side (back side) of the sheet.

In FIG. 1, a laser scanning unit 12 and a fixing unit 10 as a fixing portion are illustrated. A sheet discharge portion 13 includes a sheet discharge/stacking table 16. A controller board 11 controls the operation of the laser beam printer 1 and has a function of image forming processing of an image signal of a computer (not shown) connected thereto.

Next, an image forming operation of the thus constructed laser beam printer 1 will be described.

When image information is sent from a personal computer (not shown) and the controller board 11 issues a print signal after performing image formation processing of this image information, the sheet P stacked on the sheet feed cassette 104 detachably attached to the apparatus body 1A is fed by the feeding roller 6 one by one. After that, it is fed to a nip between the photosensitive drum 8 in the process cartridge 7 and the transfer roller 9.

On the other hand, based on the print command and image information, a laser beam obtained by converting the image information into a bit image is irradiated from the laser scanning unit 12 onto the photosensitive drum, and a latent image is formed on the surface of the photosensitive drum 8 according to this bit image. Moreover, by developing this latent image, a toner image is formed on the photosensitive drum.

Then, the toner image thus formed on the photosensitive drum is thereafter transferred onto the sheet P having been fed into the nip between the photosensitive drum 8 and the transfer roller 9. Moreover, the sheet P on which the toner image has been transferred is fed to the fixing unit 10, where the toner image is fixed semi-permanently by applying heat and pressure by the fixing unit 10.

When the controller board 11 has received a signal for one-side printing, the position of the flapper 39 is at a position shown by a solid line. The signal for one-side printing is a signal sent from a personal computer (not shown) to the controller board 11 as with the image signal.

By this, the sheet P having passed through the fixing unit 10 is fed to the nip between the after-fixation roller 17 and the first rotatable member 18 and then, fed to the sheet discharge portion 13 through a discharge guide 20 and the flapper 39. After that, the sheet is discharged by forward rotation of the discharge roller 14, which is a sheet conveying unit capable of forward/reverse rotation onto the sheet discharge/stacking table 16.

On the other hand, when the controller board 11 has received a signal for double-side printing, the sheet is conveyed by the discharge roller 14 by forward rotation toward the sheet discharge/stacking table 16 and then, the sheet trailing edge is reversed after leaving the tip end of the flapper 39, and the flapper 39 is moved to a position shown by a broken line.

By this, the sheet P is held and conveyed between the after-fixation roller 17 and the second rotatable member 19 in the state where the leading edge and trailing edge are reversed, enters the re-conveying path R via the reversing path 37 and is conveyed to the lateral registration correction portion 23. After that, at the lateral registration correction portion 23, the sheet is brought closer to the reference guide 24 by the oblique-feed roller 25 and the oblique-feed rotatable member 26, and thereby the position in the width direction is corrected.

The sheet P after lateral registration correction in this way is conveyed by the sheet re-feeding roller 22 and the sheet re-feeding rotatable member 30 and sent to the image forming portion 2 again through the joining point 21 with a conveying path from the sheet feed cassette 4. And at the image forming portion 2, a second side image is formed and then, the sheet is stacked onto the sheet discharge table 16 by the sheet discharge portion 13.

A lower conveying guide 27 is a path member constituting the bottom surface of the re-conveying path R as an example of a sheet conveying path. This lower conveying guide 27 is supported pivotally with a rotating shaft 27*a* provided at one end portion (rear end portion) as its fulcrum.

Further, a release lever 46 is a lock release unit provided at the front part of the apparatus body 1A capable of being pulled out in an arrow H direction. A pressure release cam 41 is a locking unit for locking the front side end portion of the lower conveying guide 27 and rotating in conjunction with operation of the release lever 46. Normally, since this pressure release cam 41 locks the front side end portion of the lower conveying guide 27, the lower conveying guide 27 is held at a closed position constituting the re-conveying path R as shown in FIG. 1.

If a jam occurs in the re-conveying path, for example, the sheet feed cassette 104 is pulled out from the apparatus body 1A and then, the release lever 46 is pulled out in the direction indicated by the arrow H in order to handle the jam.

When the release lever 46 is pulled out in this way, the pressure release cam 41 rotates clockwise, and thereby support of the lower conveying guide 27 is released and the lower conveying guide 27 is rotated downward (clockwise) with a fulcrum 27*a* as its rotation center. Then, by this downward rotation of the lower conveying guide 27, the re-conveying path R is opened, and by pulling out the jammed sheet P in the same direction as the pullout direction of the sheet feed cassette 104 in this state, the jamming is cleared.

In FIG. 1, a sheet presence or absence sensor portion 150A is a detecting device for detecting the presence or absence of the sheet P stacked and contained in the sheet feed cassette 104. This sheet presence or absence sensor portion 150A is provided with a sensor flag 150 and a photo-sensor 151. In FIG. 1, an inner plate 104*a* is provided at the sheet feed cassette 104 capable of being raised. This inner plate 104*a* is urged toward the feeding roller side by an urging unit (not shown) so as to press the sheet P stacked on the inner plate 104*a* toward the feeding roller 6.

Figure 2:
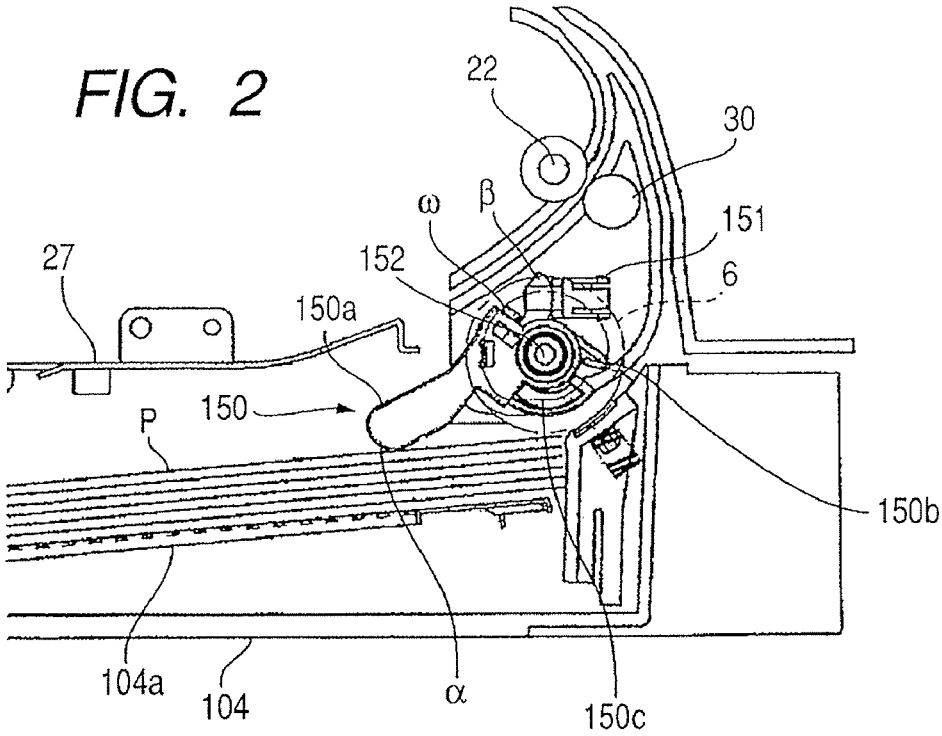
FIG. 2 is a view illustrating a construction of a sheet presence or absence sensor portion provided at the above laser beam printer.
Figure 3:
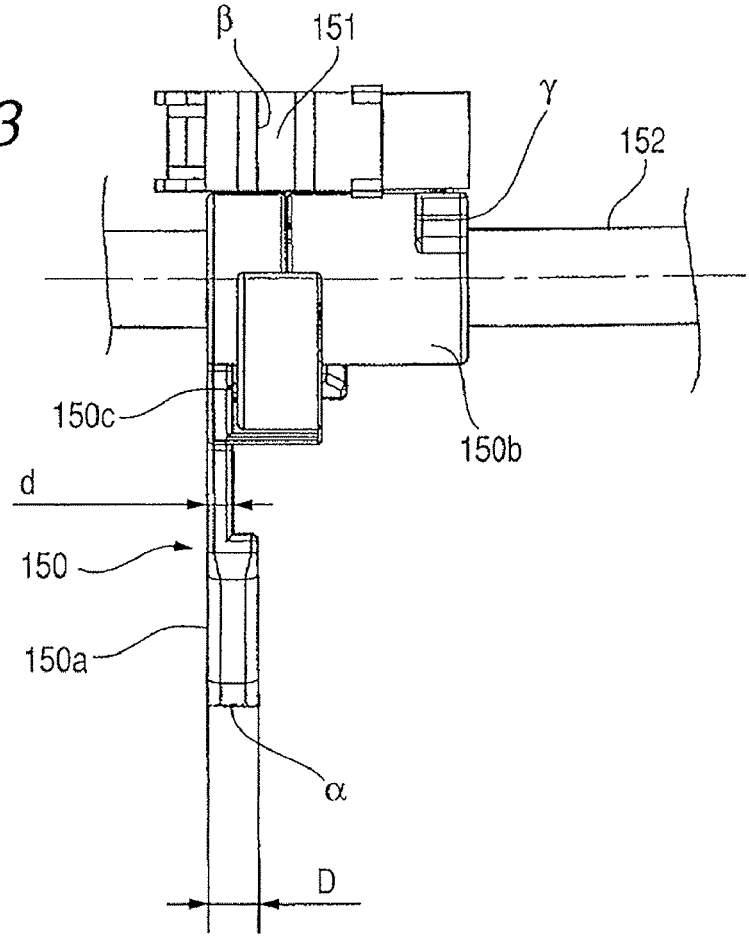
FIG. 3 is a side view illustrating the construction of the above sheet presence or absence sensor portion.

Moreover, the sensor flag 150 is pivotably held by a shaft 152 as shown in FIGS. 2 and 3 and is divided into an arm portion 150*a* in contact with the sheet P inside the sheet feed cassette 104 and a stopper portion 150*b* provided with a lock portion ω and an abutment portion γ.

The arm portion 150*a* and the stopper portion 150*b* are connected to each other through a compression spring 150*c*, which is an elastic member locked at the both ends by the arm portion 150*a* and the stopper portion 150*b*. By this, when the arm portion 150*a* is rotated, the stopper portion 150*b* is also rotated through the compression spring 150*c*.

When there is the sheet P inside the sheet feed cassette 104 as shown in FIG. 2, a flag portion β of the arm portion 150*a* is designed to shield a light emitting portion of the photo-sensor 151. In this state, the lock portion ω provided at the stopper portion 150*b* is pressed into contact with the upper end of the arm portion 150*a* by the compression spring 150*c*.

The flag portion β of the arm portion 150*a* thus shields the light emitting portion of the photo-sensor 151, which enables the sheet presence or absence sensor portion 150A to detect the presence of the sheet P. In this embodiment, the presence of the sheet is detected when the light emitting portion of the photo-sensor 151 is shielded, but the presence of the sheet may be detected when it is not shielded.

On the other hand, when the sheet P is fed sequentially and there is no sheet on the inner plate 104*a* any more, the arm portion 150*a* of the sensor flag 150 enters a slit (not shown) provided at the inner plate 104*a* by the gravitational force of the arm portion 150*a* and is rotated downward. Then, by this downward rotation of the arm portion 150*a*, the flag portion p is separated from the light emitting portion of the photo-sensor 151, and thereby the sheet presence or absence sensor portion 150A can detect absence of the sheet.

Also, when the arm portion 150*a* is rotated in this way, the stopper portion 150*b* is also rotated upward through the compression spring 150*c*, and the rotated stopper portion 150*b* has the abutment portion γ abutted to the bottom surface (regulating portion) of the photo-sensor 151, for example, in the end. As a result, the sensor flag 150 is stopped at a predetermined stop position shown in FIG. 4 so as not to obstruct subsequent attachment/detachment of the sheet feed cassette 104. That is, when there is no sheet in the sheet feed cassette 104, the rotation of the stopper portion 150*b* is regulated, and along with this the arm portion 150*a* is stopped at a predetermined stop position to determine the position. In this embodiment, the regulating portion to which the abutment portion γ is abutted is the bottom surface of the photo-sensor 151, but not limited to this, an exclusive regulating portion may be provided.

By this construction, the arm portion 150*a* can retreat from the position determined by the stopper portion 150*b* to a position outside the rotating range of the arm portion 150*a* for detecting operation of the sheet against the compression spring 150*c*.

By this construction, the jam clearance inside the re-conveying path R is carried out as follows.

Figure 4:
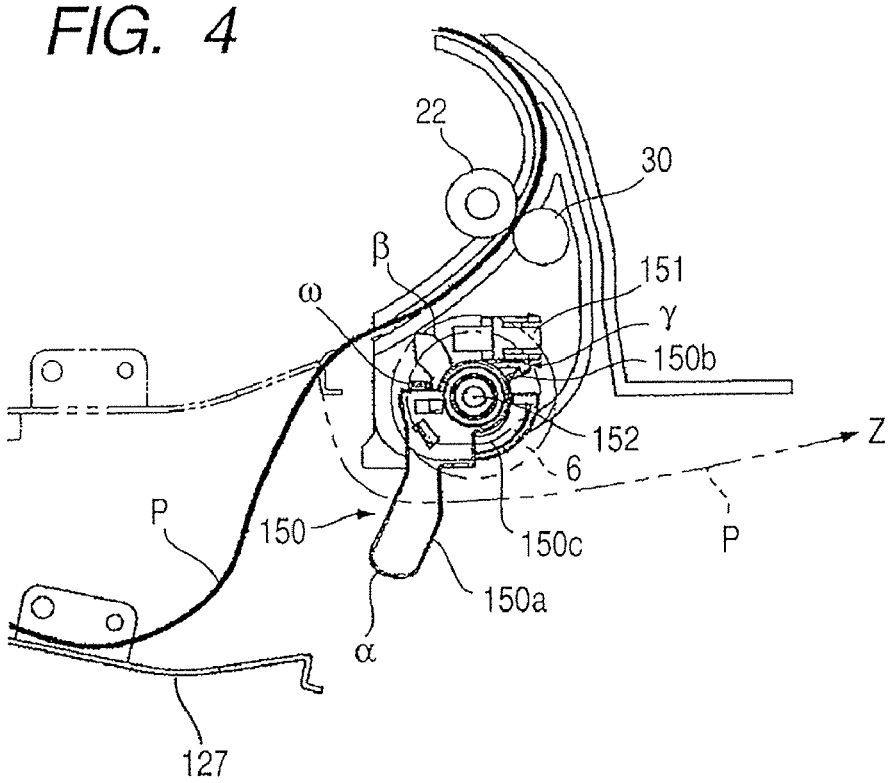
FIG. 4 is a view illustrating a state of the above sheet presence or absence sensor portion before a jammed sheet is pulled out.

When a jamming occurs, the sheet feed cassette 104 is pulled out from the apparatus body 1A, and when the sheet feed cassette 104 has been pulled out, the arm portion 150*a* of the sensor flag 150 is rotated downward to the predetermined stop position shown in FIG. 4 by the gravitational force of the arm portion 150*a*.

Figure 5:
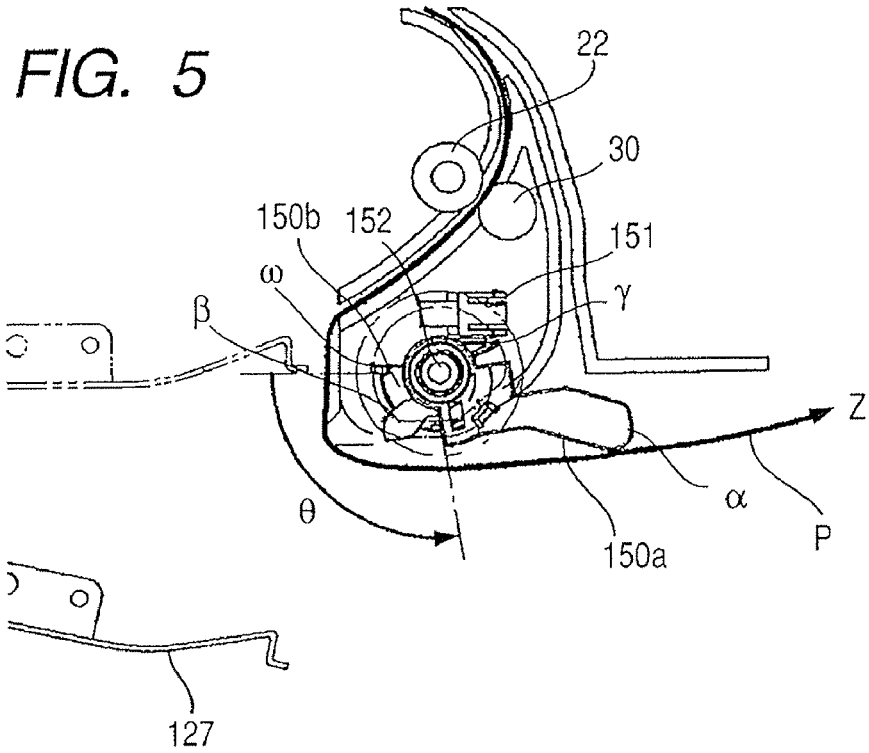
FIG. 5 is a view illustrating a state of the above sheet presence or absence sensor portion when the jammed sheet is pulled out.

After that, the lower conveying guide 27 is rotated downward by pulling the release lever 46, and when the jammed sheet P is to be pulled out in this state, the sheet P receives resistance by a nip pressure between the sheet re-feeding roller 22 and the rotatable member 30 and the curved conveying path around it. As a result, the sheet P is pulled in the direction indicated by the arrow Z as shown in FIG. 5, and along with this, the arm portion 150*a* is pressed by the sheet P to be rotated and retreated in the arrow direction from the predetermined stop position to the arrow direction with the shaft 152 as the fulcrum.

When the arm portion 150*a* is rotated in this way, the abutment portion γ of the stopper portion 150*b* remains abutted to the bottom surface of the photo-sensor 151. Thus, only the arm portion 150*a* is rotated by θ in the counterclockwise direction, which is a direction to compress the compression spring 150*c*. Then, when the sheet P is pulled out in this way, even if the jammed sheet P touches the arm portion 150*a*, the arm portion 150*a* is pressed by the sheet P and rotated (retreated) from the predetermined stop position, and therefore the jammed sheet P is not torn.

Spring pressure of the compression spring 150*c* is set at a spring pressure to the degree that, after the sheet P has been pulled out and the pressing by the sheet P is released, the arm portion 150*a* in the state shown in FIG. 4 can be automatically returned to the state shown in FIG. 3. By this, when the jammed sheet P is pulled out, the arm portion 150*a* is returned to the state where the lock portion ω of the stopper portion 150*b* is slightly abutted to the arm portion 150*a* as shown in FIG. 3 by opening of the compression spring 150*c*.

In this embodiment, when the jammed sheet P is to be pulled out, even if the arm portion 150*a* touches the sheet P, the arm portion 150*a* is designed to be pressed by the sheet P and retreated (rotated) from the predetermined stop position to the pullout direction against the spring force (elastic force) of the compression spring 150*c*. By this, breakage of the sheet P when the jammed sheet P is to be pulled out can be prevented, and the sheet P can be cleared without leaving the sheet P in the apparatus. Also, when the jammed sheet P has been pulled out, the arm portion 150*a* returns to the original predetermined stop position by the compression spring 150*c*, and thereby achieves improvement of usability.

In this embodiment, the relation between a width D of a sheet contact portion α of the arm portion 150*a* in the sensor flag 150 and a fundamental thickness d of the arm portion 150*a* is set at D>d as shown in FIG. 3 as mentioned above.

By this, when the sheet P is pressed into contact with the sensor flag 150 in jam clearance, the pressing pressure working on the sheet can be distributed, and thereby breakage of the sheet P can be prevented, and jamming can be cleared smoothly without leaving the sheet P in the apparatus.

Next, a second embodiment of the present invention will be described.

Figure 6A:
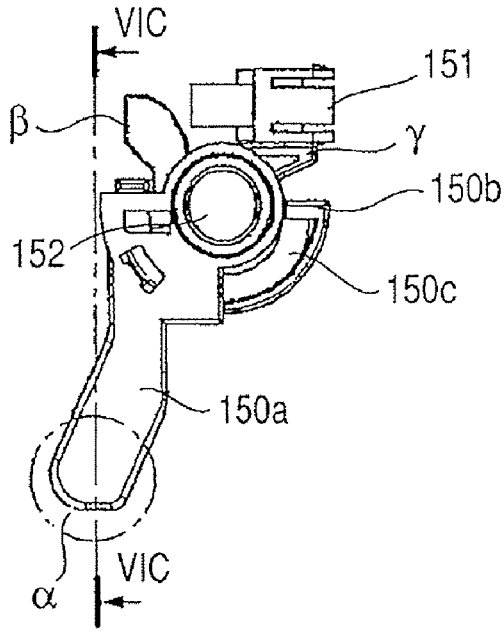
FIGS. 6A, 6B and 6C are views illustrating the construction of the sheet presence or absence sensor portion provided at an image forming apparatus according to a second embodiment of the present invention.
Figure 6B:
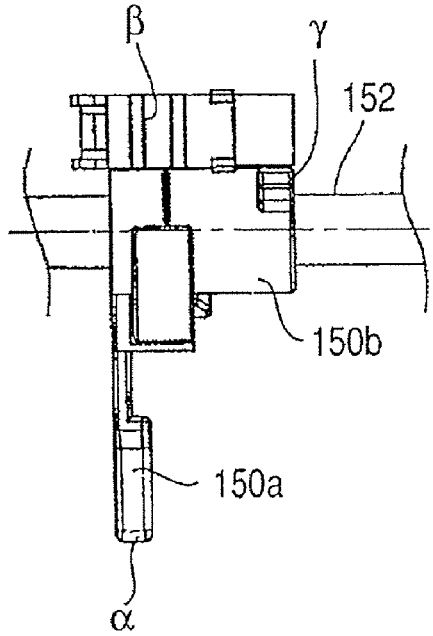
Figure 6C:
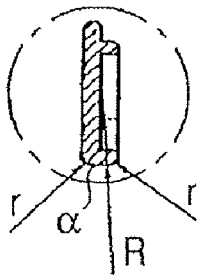
Figure 7:
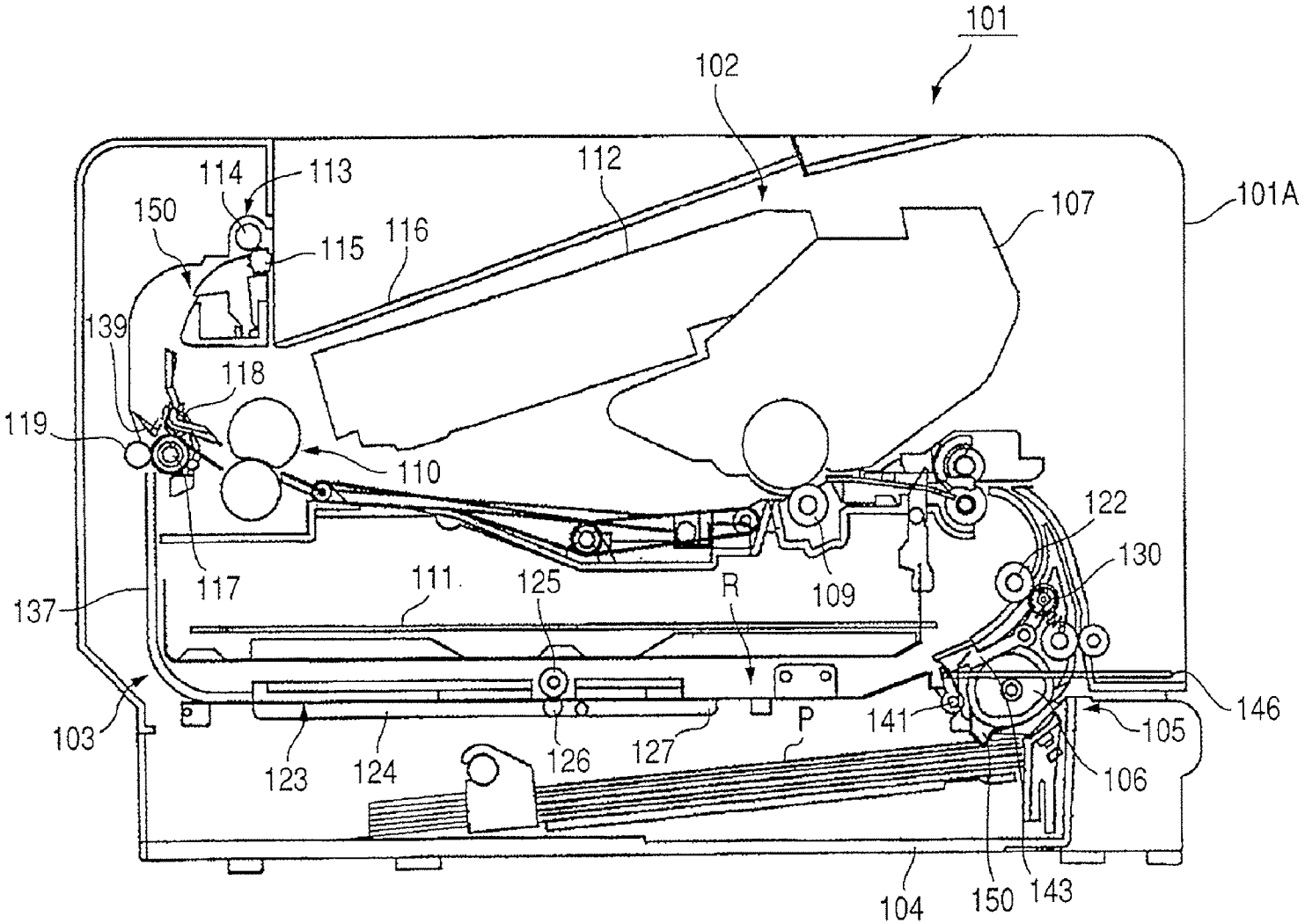
FIG. 7 is a view illustrating a construction of a conventional laser beam printer.
Figure 8:
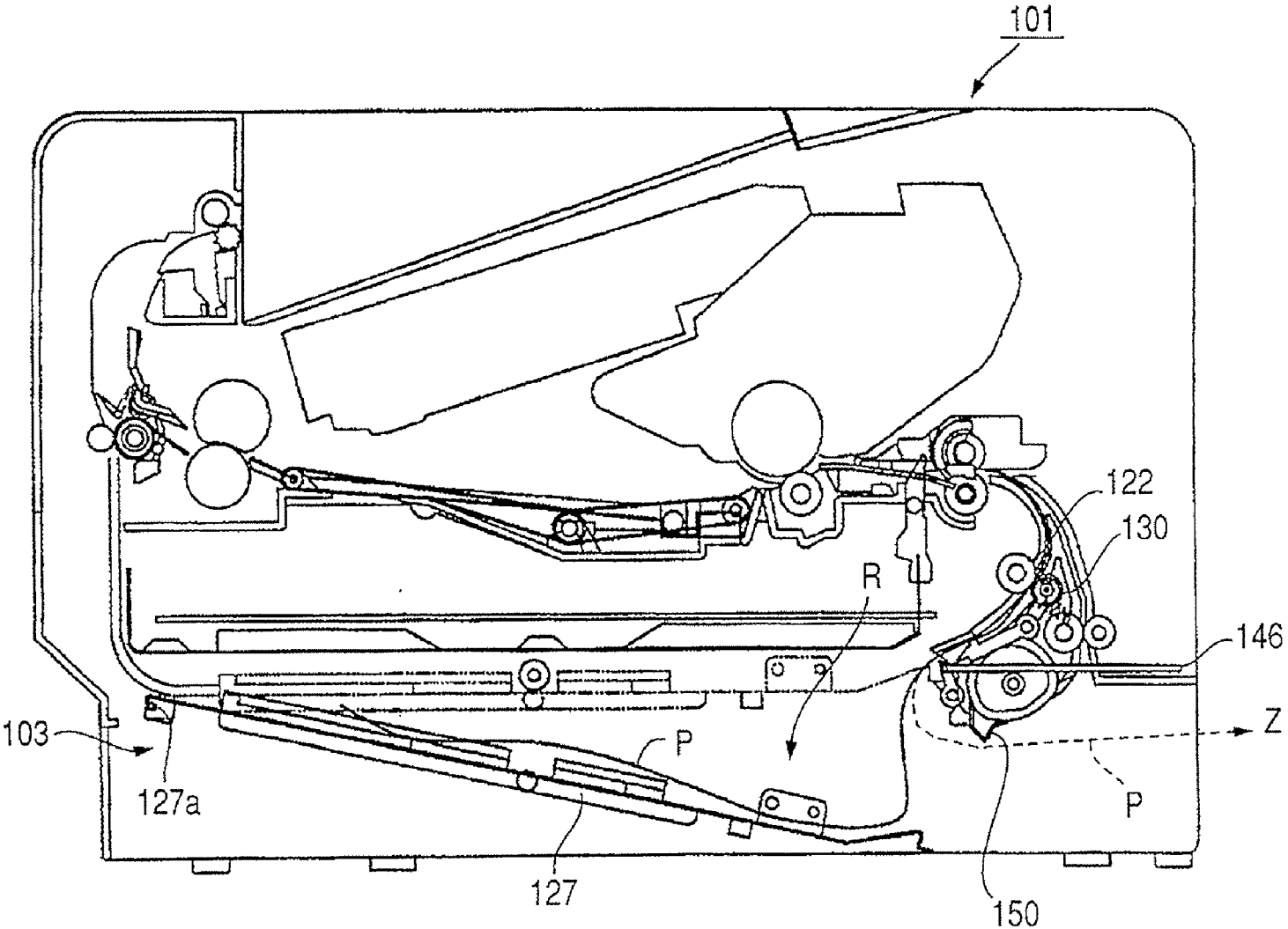
FIG. 8 is a view illustrating a state at jam clearance in the above laser beam printer.

FIGS. 6A, 6B and 6C are views illustrating the construction of the sheet presence or absence sensor portion provided in the image forming apparatus according to this embodiment. FIG. 6A is a front view of the sheet presence or absence sensor portion, FIG. 6B is a side view of the sheet presence or absence sensor portion, and FIG. 6C is a VIC-VIC sectional view of FIG. 6A. Also, FIGS. 6A to 6C show the same or corresponding portions as those in the above-mentioned FIGS. 3 and 4.

In this embodiment, the sectional shape of the contact portion α with the sheet P of the arm potion 150*a* of the sensor flag 150 is made in the R shape with the entire region rounded with an edge portion r cut off as shown in FIG. 6C. That is, the both ends in the width direction orthogonal to the sheet pull-out direction of the arm portion 150*a* are curved.

This can prevent breakage of a sheet due to wrapping of the sheet at jam handling more surely, and thereby improve jam handling capability.

The image forming apparatus for forming an image on both sides of a sheet has been described so far, but the present invention can be also applied to any image forming apparatus for forming an image on one side only if it is provided with the detecting device for detecting the presence or absence of the sheet by the sensor flag 150.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-018268, filed Jan. 26, 2006 which is hereby incorporated by reference herein in its entirety.

What is claimed is:

1. An image forming apparatus comprising: an image forming portion; a conveying path configured to convey a sheet to the image forming portion; a sheet containing portion detachably attached to an image forming apparatus body and configured to contain the sheet; and a detecting device configured to detect a state of the sheet contained in the sheet containing portion, the detecting device provided between the conveying path and the sheet containing portion, the detecting device including:

an arm portion which is rotatable and brought into contact with the contained sheet in the sheet containing portion;

a sensor configured to output a signal according to a position of the arm portion;

a stopper portion rotatable in association with the rotation of the arm portion; and an elastic member configured to elastically connect the arm portion and the stopper portion, wherein the stopper portion is rotated with the arm portion while the arm portion is in contact with the contained sheet, the stopper portion determines a position of the arm portion while the arm portion is not in contact with the contained sheet, and the arm portion can be retreated from the position determined by the stopper portion to an outside position against an elastic force of the elastic member.

2. An image forming apparatus according to claim 1, wherein in a state in which the arm portion is out of contact with the sheet contained in the sheet containing portion, the stopper portion is brought into contact with a regulating portion so as to determine a position of the arm portion.

3. An image forming apparatus according to claim 2, wherein the regulating portion is provided at the sensor.

4. An image forming apparatus according to claim 1, wherein the conveying path is a re-conveying path for reversing the sheet so that an image is formed on a second face opposite to a first face of the sheet on which an image is formed by the image forming portion and for conveying the sheet to the image forming portion again, and in the re-conveying path, a lower conveying guide arranged above the sheet containing portion and constituting the re-conveying path is openable and closable with respect to the sheet containing portion side so that the sheet can be removed from the re-conveying path by pulling out the sheet containing portion from the image forming apparatus body and opening the lower-conveying guide.

5. An image forming apparatus according to claim 1, wherein a relation between a contact width D with the sheet and a fundamental thickness d of the arm portion is D>d.

6. An image forming apparatus according to claim 1, wherein both ends of the arm portion in a width direction orthogonal to a sheet pullout direction are curved.

* * * * *